US007207956B2

(12) United States Patent
Mizoguchi et al.

(10) Patent No.: US 7,207,956 B2
(45) Date of Patent: Apr. 24, 2007

(54) MASSAGE MACHINE

(75) Inventors: Souichirou Mizoguchi, Hikone (JP); Junji Nakamura, Hikone (JP); Masatoshi Dairin, Hikone (JP); Munekiyo Ikebe, Hikone (JP); Masahiro Kirigaya, Kyotanabe (JP)

(73) Assignee: Matsushita Electric Works, Ltd., Osaka (JP)

( * ) Notice: Subject to any disclaimer, the term of this patent is extended or adjusted under 35 U.S.C. 154(b) by 269 days.

(21) Appl. No.: 10/859,134

(22) Filed: Jun. 3, 2004

(65) Prior Publication Data

US 2005/0101890 A1 May 12, 2005

(30) Foreign Application Priority Data

Jun. 4, 2003 (JP) ..... 2003-160013

(51) Int. Cl.
*A61H 15/00* (2006.01)

(52) U.S. Cl. ..... 601/99; 601/84; 601/100; 601/101; 601/103

(58) Field of Classification Search ..... 601/84, 601/90, 94, 97, 98, 99, 100–103, 112, 113, 601/116; 297/217.1
See application file for complete search history.

(56) References Cited

U.S. PATENT DOCUMENTS 5,792,080 A 8/1998 Ookawa et al.
6,494,850 B1 12/2002 Kitadou et al.
6,540,701 B1 * 4/2003 Inada ..... 601/99
6,695,799 B2 2/2004 Kitadou et al.

FOREIGN PATENT DOCUMENTS

| | | |
|---|---|---|
| EP | 1062934 | 12/2000 |
| EP | 1145700 | 10/2001 |
| EP | 1230904 | 8/2002 |
| JP | 2000-237259 | 9/2000 |

OTHER PUBLICATIONS

English language Abstract of JP 2000-237259.

* cited by examiner

*Primary Examiner*—Quang D. Thanh
(74) *Attorney, Agent, or Firm*—Greenblum & Bernstein, P.L.C.

(57) ABSTRACT

A pressure-sensing massage machine that resolves the problems of difficult assembly and adjustment and the occurrence of operational errors common to a sensing mechanism that uses many components and devices. The massage machine of the present invention is able to monitor the pressure applied to the massage recipient by a motor-driven movably extending massaging member. A flexible member is provided in the transmission located between the massage member and the motor that drives the massage member, and a pressure sensing mechanism monitors the pressure applied to the massage recipient through the flexible displacement of the flexible member.

6 Claims, 6 Drawing Sheets

MASSAGE MACHINE

BACKGROUND OF THE INVENTION

1. Field of the Invention

The invention relates to a massage machine, and more particularly, to a massage machine that provides various massaging movements to a massaging member.

2. Description of the Related Art

Massage machines known in the art include those constructed as massage chairs equipped with a massaging member, in the form of a roller, that operates with a compound massaging movement, such as the massage chair described in Japanese Kokai (laid open) Patent Publication 2000-237259. Conventional massage chairs of this type are equipped with a sensing mechanism able to monitor the pressure applied by the massaging member to the recipient of the massage. The sensing mechanism monitors the pressure applied to the massaging member as it traverses the massage recipient's neck, shoulders, back, and lower back, and makes a record of the contour resulting therefrom. The massage chair is thus able to apply numerous massages based on the recorded contour.

Conventional massage machines incorporate a large number of components and devices as a means of monitoring the pressure of the massage. Therefore, there are problems relating to the accuracy of the calculations and the difficulty of assembling and adjusting the pressure sensing mechanism because of the large number of components through which the pressure of the massage must be conveyed.

SUMMARY OF THE INVENTION

The present invention, taking the shortcomings of the prior art into consideration, provides a massage device that eliminates the problems associated with a pressure sensing mechanism that requires a large number of components and devices, problems such as difficult assembly and adjustment procedures, and pressure calculation errors that result from the need to convey the monitored pressure through a large number of components.

The present invention provides a massage machine capable of monitoring the pressure applied by a motor-driven massage member against a massage recipient, wherein a flexible member is provided in a transmission located between the motor that drives the massage member and the massage member itself, and a pressure sensing mechanism is provided to monitor the pressure applied to the massage recipient by sensing the displacement of flexible member.

The structure of the present invention reduces the number of components that forms the pressure sensing mechanism to only a flexible member and a displacement gauge, and thus eliminates the problems, such as erroneous calculation and the difficulty of assembling and adjusting the pressure sensing mechanism, associated with conveying the pressure applied to the massage recipient through a large number of components.

Moreover, the pressure sensing mechanism of the present invention is equipped with a worm shaft provided in the motor side of the transmission, and a worm wheel provided in the massage element side of the transmission, with the worm shaft being axially movable and tensioned in the axial direction by a spring.

In the present invention, a displacement gauge is provided to measure the extent of axial displacement of the worm shaft when the pressure of the massage element against the massage recipient is transferred to the worm shaft through the worm wheel. This type of worm shaft and worm wheel structure is able to operate as a simple displacement monitoring mechanism.

Moreover, in the present invention, a gap sensor may be employed as the displacement gauge. The use of a gap sensor allows the pressure monitoring mechanism to be made smaller and of lighter weight.

Further, in the present invention, a potentiometer may be employed as the displacement gauge. The use of a potentiometer eliminates the possibility of external interference such as electromagnetic noise which can induce operational errors.

Further, a non-linear response spring may be used as a spring that applies pressure to the worm shaft. The use of a non-linear response spring provides a monitoring capability that is more sensitive to a wider range of pressure.

Moreover, multiple linear response springs arranged in series alignment may be used to form the non-linear response spring. The use of multiple linear response springs aligned in series is effective for use with a massage recipient who has an extremely light body weight.

Moreover, multiple linear response springs arranged in parallel alignment may be used to form the non-linear response spring. The use of multiple linear response springs aligned in parallel is effective for use with a massage recipient who has an extremely heavy body weight.

An aspect of the present invention provides a massage machine to monitor the pressure applied by a motor driven massage member against the body of a massage recipient including a flexible member provided in a transmission positioned between a massage member drive motor and the motor driven massage member, and a pressure sensing mechanism configured to monitor pressure applied to the body of the massage recipient by sensing displacement of the flexible member.

In a further aspect of the present invention, the pressure sensing mechanism includes a worm shaft provided at the motor side of the transmission and a worm wheel provided on the massage element side of the transmission, the worm shaft being movable in the axial direction, and tensioned in the axial direction by a spring, and a displacement gauge configured to monitor the amount of axial displacement of the worm shaft resulting from pressure of the massage member against the body of the massage recipient transferred to the worm shaft through the worm wheel. Further, the displacement gauge may include a gap sensor or a potentiometer.

In a further aspect of the present invention, the spring configured to apply pressure to the worm shaft is a nonlinear response spring. Further, the nonlinear response spring may include multiple linear response springs arranged in series alignment; the nonlinear response spring may include multiple linear springs arranged in parallel alignment.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF THE PREFERRED EMBODIMENTS

Figure 1:
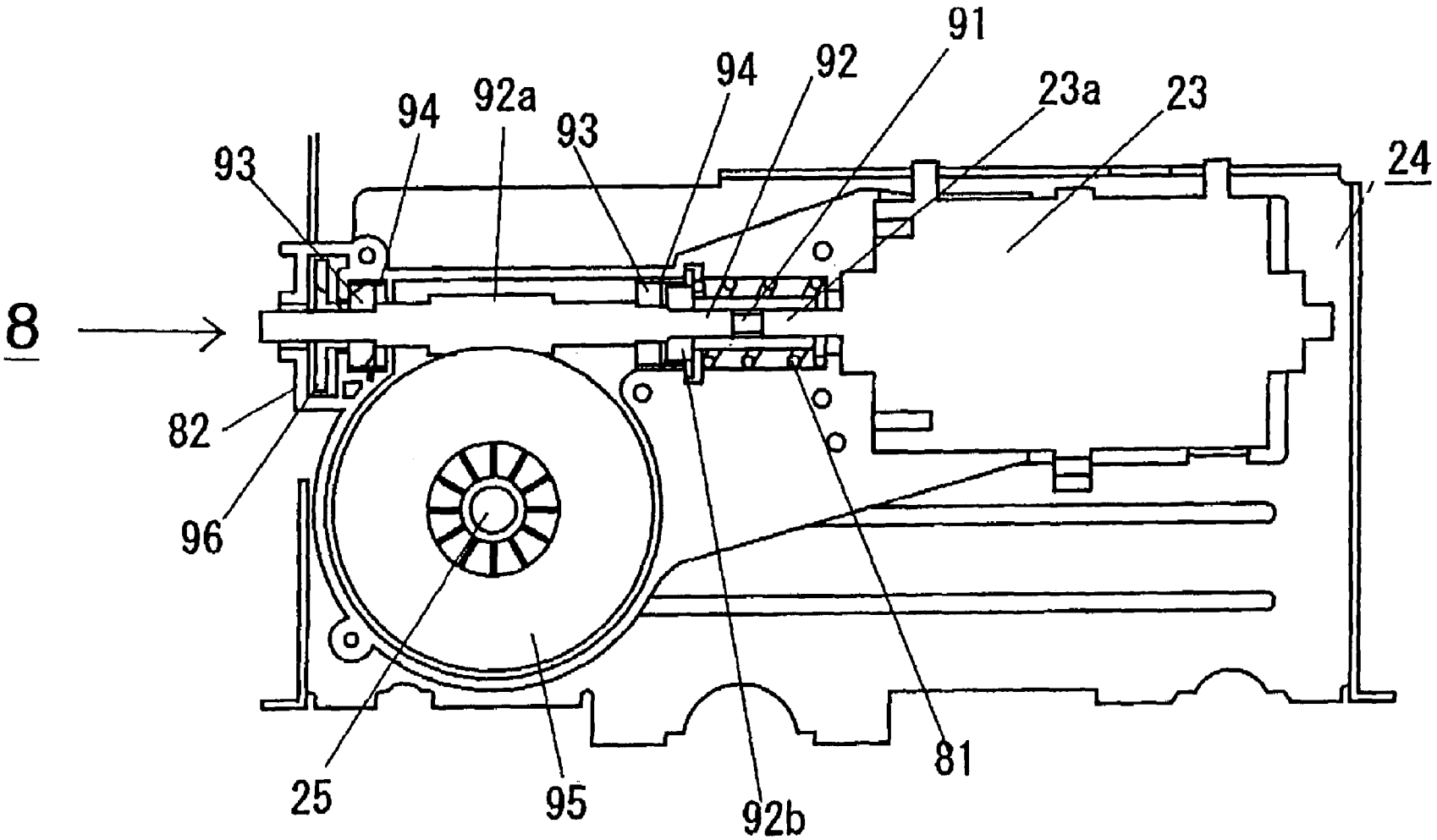
FIG. 1 is a cross sectional view of components of the massage machine according to an embodiment of the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

A more detailed description of an embodiment of the present invention shown in the drawings is discussed below.

The massage machine of the present invention may be provided as a massage chair that includes a backrest portion extending in an approximate upward direction from the rearward end of a seat portion, and a massage member through which a therapeutic mechanical massage is provided from the backrest portion. The person making use of the massage chair (the massage recipient) sits on the seat portion and leans against the backrest portion to receive a tapping, rubbing, or other similar therapeutic mechanical massage provided by the massage member.

Figure 3B:
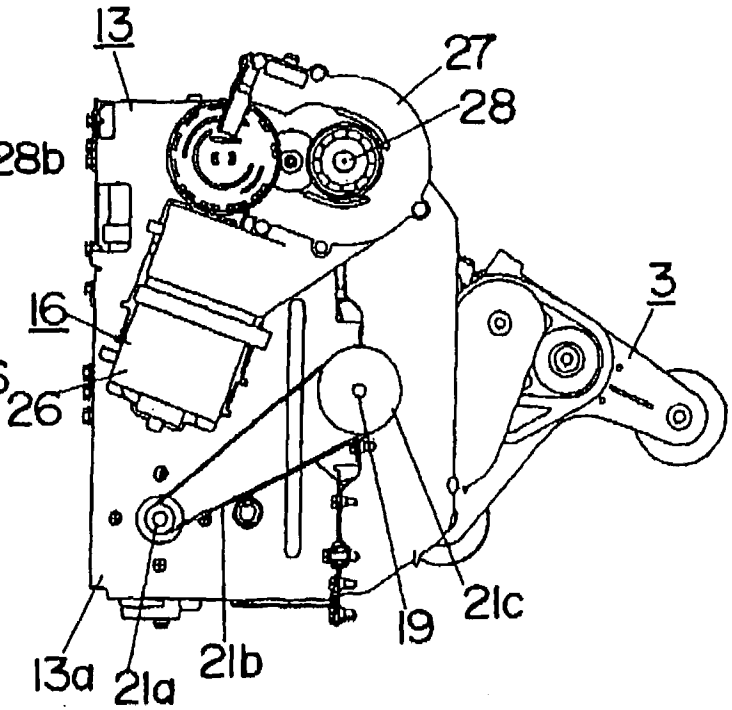
FIG. 3*b* is an elevational side view of the main block of the massage machine of the embodiment of FIG. 1.
Figure 3A:
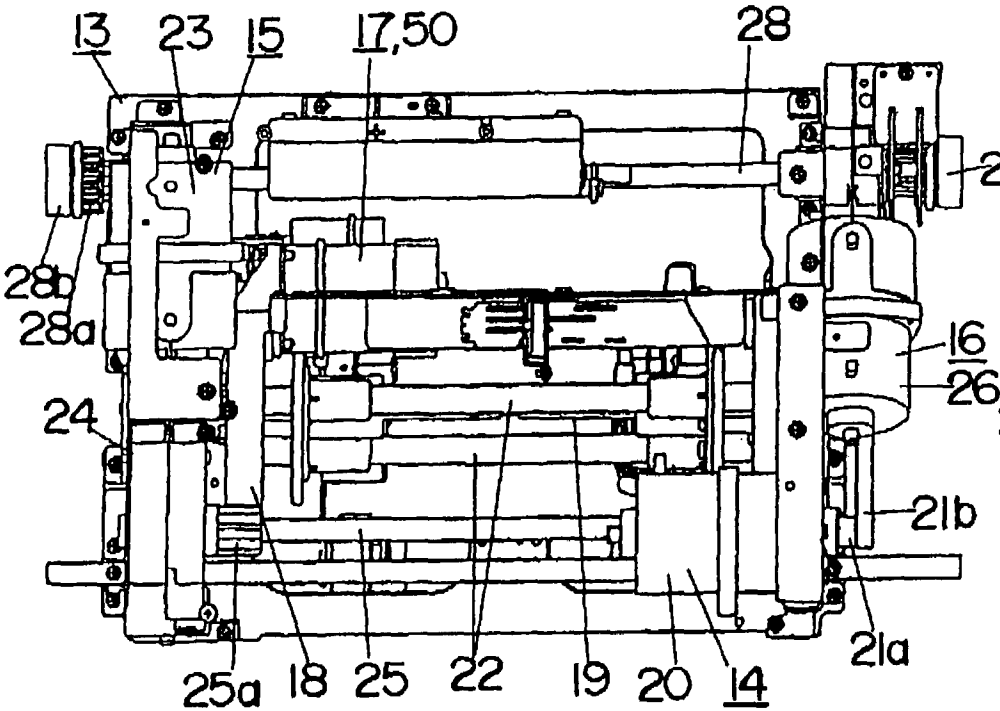
FIG. 3*a* is an elevational rear view of the main block of the massage machine of the embodiment of FIG. 1.

FIG. 3 illustrates main block 13 which is the primary component that generates the mechanical massage. Main block 13 is located at the backrest portion and may be moved in upward and downward directions.

As described below, main block 13 is a box-like frame structure to which various mechanisms are connected, and includes massage unit 3 to which the massage member is connected, extension drive unit 15 that extends and retracts massage unit 3 toward and away from the massage recipient while also moving in both horizontal and vertical directions, transverse drive unit 14, vertical-drive unit 16, and tapping drive portion 17 that drives the massaging member with a tapping action. The massage member may be any suitable massage member such as, for example, massage roller 48.

As shown in FIG. 3, transverse drive shaft 19 of transverse drive unit 14 is rotatably provided between frame side plates 13*a* of main block 13, and transverse drive motor 20 is mounted to the frame. Transverse drive unit 14 is constructed so that drive motor 20 rotatably drives transverse drive shaft 19 through transverse drive pulley 21*a*, transverse drive belt 21*b*, and transverse driven pulley 21*c*. Two male threaded portions (not shown in the drawings) are formed in the axial direction on transverse drive shaft 19, the threaded portions starting at the axial center of shaft 19 and extending axially outward therefrom in opposing directions. These left and right male threaded portions formed on transverse drive shaft 19 mesh with respective transmission nuts 35 of each massage unit 3, thereby resulting in the two massage units 3 moving in mutually approaching and separating directions from the forward and reverse rotations of shaft 19. In other words, massage units 3 are driven horizontally in left and right directions.

Figure 4:
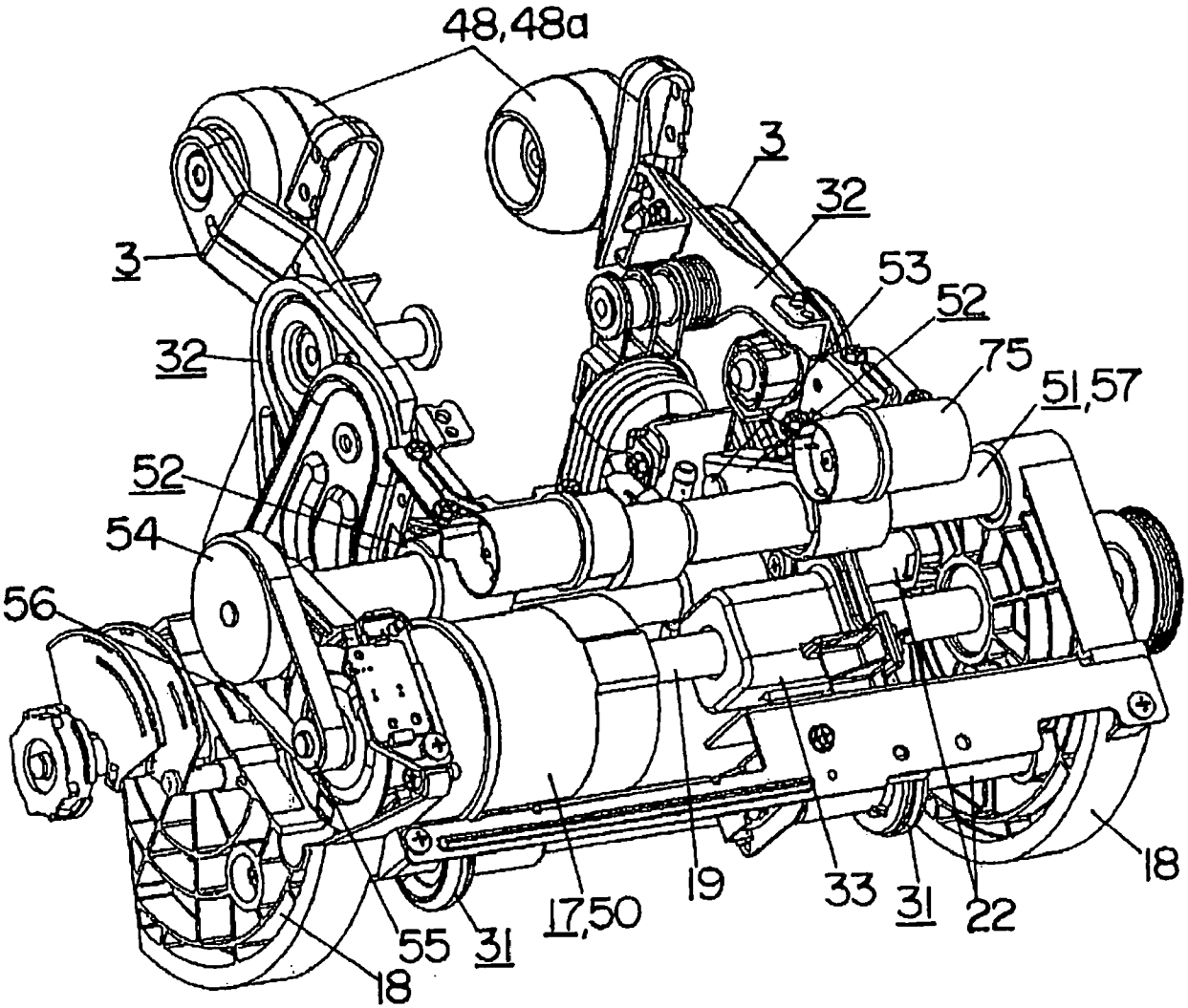
FIG. 4 is a rear perspective view of the main block of the massage machine invention of the embodiment of FIG. 1 showing the extension drive unit, segment gears, transverse drive unit, and tapping drive part.

As shown in FIGS. 3 and 4, a pair of segment gears 18 are rotatably mounted to the frame of main block 13, each segment gear 18 located externally to the outward-most horizontal traversing point of the corresponding massage unit 3. Each segment gear 18 incorporates teeth formed on the surface of the radial arc portion, and includes a hole located at the radial center of the arc portion into which transverse drive shaft 19 is inserted. Two transverse support shafts 22 are suspended between segment gears 18 parallel to transverse drive shaft 19, and are movably inserted within through holes (not shown in the drawings) formed in massage units 3.

A pair of transmission gears 25*a*, which transmit the torque generated by extension drive motor 23 (a part of extension drive unit 15 described below), mesh with corresponding right and left segment gears 18.

In extension drive unit 15, the torque generated by extension drive motor 23 is applied to the transmission (described below in more detail) within extension gearbox 24 from where it is transmitted to extension drive shaft 25 which rotates in the frame of main block 13. Each of the two transmission gears 25*a* is attached to an end of extension drive shaft 25, each gear 25*a* meshing with corresponding left and right segment gears 18. Therefore, the forward or reverse rotation of motor 23 results in the corresponding forward or reverse rotation of extension drive shaft 25 which, in turn, rotates right and left segment gears 18, through transmission gears 25*a*, around the axial center of transverse drive shaft 19. The rotation of right and left segment gears 18, described below, results in massage unit 3, through which the two transverse support shafts 22 run between segment gears 18, rotating together with segment gears 18 around the axial center of transverse drive shaft 19. This makes it possible to vary the distance that massage rollers 48, which are attached to massage unit 3, extend toward and retract from the massage recipient. In other words, in the present embodiment, the rotation of massage unit 3 causes massage rollers 48 to move inward and outward while traversing vertically through an arc prescribed around the axial center of transverse drive shaft 19. This mechanism thus allows the pressure, which is applied against the massage recipient (M) by the massage rollers, to be increased or decreased.

Main block 13 includes vertical-drive unit 16 which is a mechanism through which the forward and reverse rotation of vertical-drive motor 26 powers vertical-drive shaft 28, to which vertical-drive pinion gears 28*a* and vertical-drive rollers 28*b* are attached to both ends thereon, in forward and reverse directions through the transmission mechanism in vertical-drive gear box 27. Vertical guide rails (not shown in the drawings) are provided in the backrest portion of the massage chair on the left and right sides of an external frame (not shown in the drawings), vertical-drive rollers 28*b* on both ends of vertical-drive shaft 28 are rotatably connected to the vertical guide rails, and the gear racks (not shown), which are formed on the vertical guide rails, mesh with vertical-drive pinion gears 28*a* provided on each end of vertical-drive shaft 28. The forward or reverse rotation of vertical-drive motor 26 drives vertical-drive pinion gears 28*a* in forward or reverse directions. Because vertical-drive pinion gears 28*a* mesh with the gear rack, the gears are able to traverse in upward and downward directions along the vertical guide rails, thus resulting in a corresponding upward or downward traverse of vertical-drive shaft 28 and main block 13.

The following will describe massage unit 3 and tapping drive portion 17.

Figure 5B:
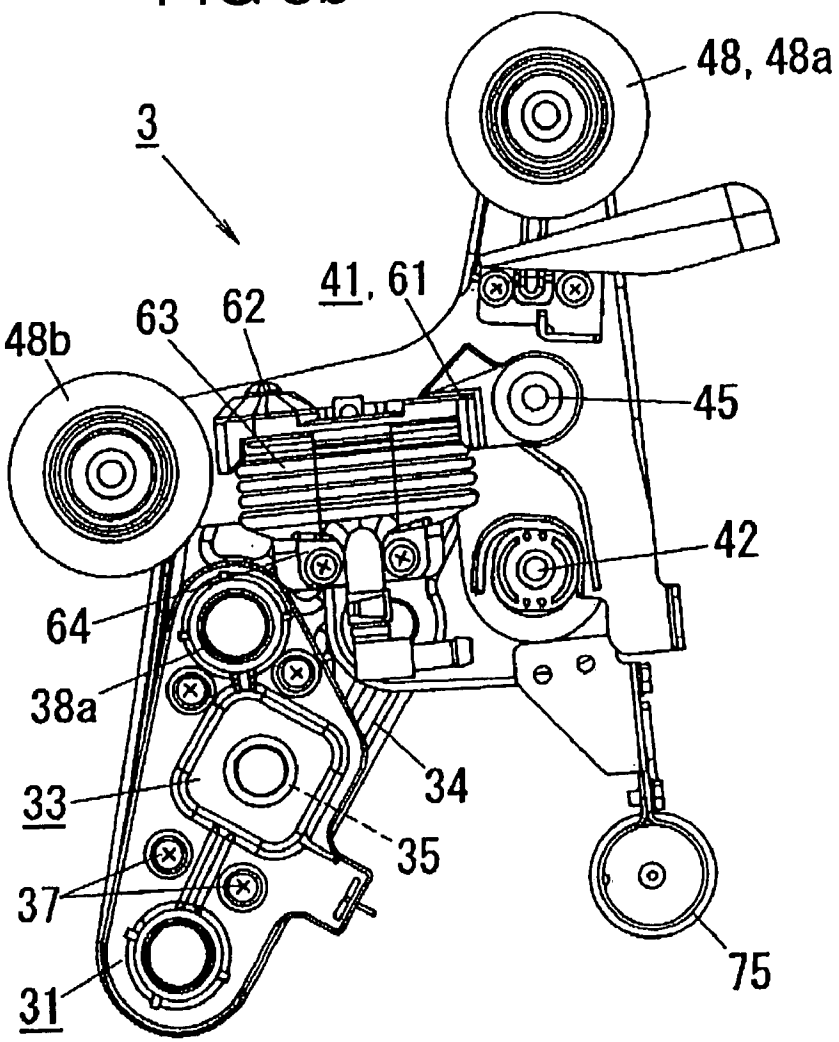
FIG. 5*b* is an elevational side view of the massage unit of the embodiment of FIG. 1.
Figure 5A:
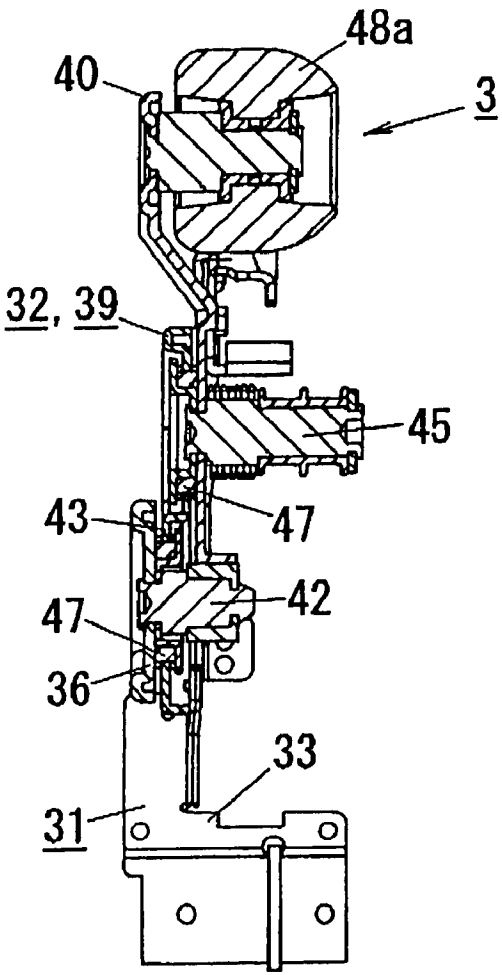
FIG. 5*a* is a cross sectional view of the massage unit of the embodiment of FIG. 1.
Figure 6:
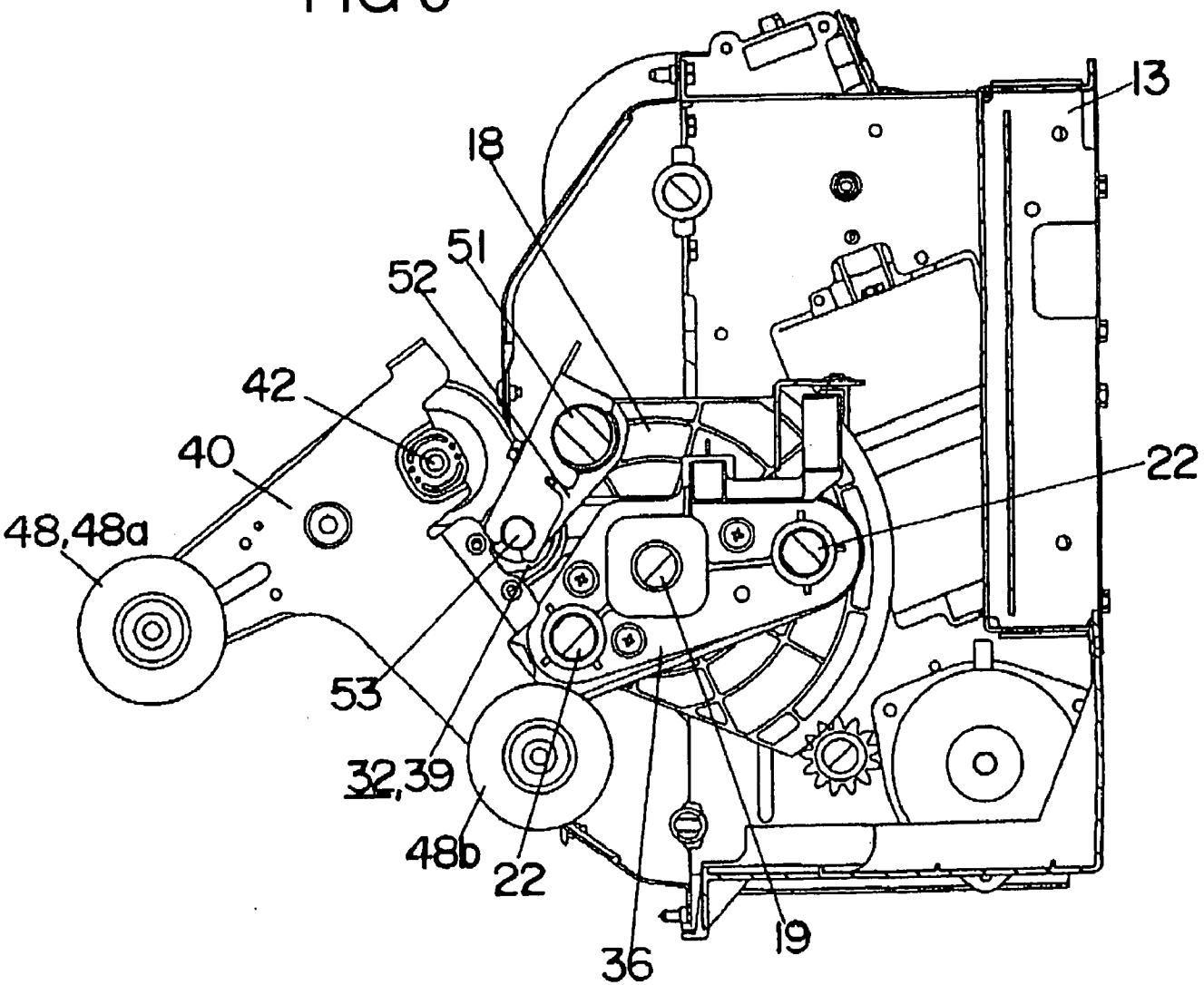
FIG. 6 is an elevational side view of the massage unit of the embodiment of FIG. 1 showing the connection between the massage unit and tapping drive portion.

As illustrated in FIGS. 5 and 6, the main structure of massage unit 3 incorporates a pair of fixed plates 31, to which are connected transmission nut 35 which meshes with the male threads on transverse drive shaft 19, and a pair of moving frames 32, each being rotatably attached to each fixed bracket 31. Fixed plates 31 and moving frames 32 are connected to corresponding left and right male threads on transverse drive shaft 19.

As fixed bracket 31 is a single structure to which box-like transmission case 33 and transverse arm 34, a boomerang-shaped member, are attached through fasteners, through holes 34*a* are formed on the opposing surfaces of fixed plates 31 to allow the passage of transverse drive shaft 19 there through, and a transmission nut 35 is provided in each through hole 34*a* in mesh with the corresponding male threads of transverse drive shaft 19. Therefore, as noted previously, the rotation of segment gears 18, which rotate concentrically with transverse drive shaft 19, together with the rotation of transverse support shaft 22, which is supported between segment gears 18 parallel to and rotatably around transverse drive shaft 19, results in fixed bracket 31 rotating as a single structure together with segment gears 18 and transverse support shaft 22.

Moving bracket 32 includes tapping plate 39 which is able to rotate with respect to fixed bracket 31, fixed massage arm 40 which is capable of rotating a small amount in respect to tapping plate 39, and shoulder grabber 41 which is provided so as to swing with respect to fixed massage arm 40.

Tapping plate 39 is rotatably supported by a shaft on fixed bracket 31. In this embodiment, stub shaft 42 extends transversely from the upper edge of fixed bracket 31, pivot hole 43 is provided at the rear end of tapping plate 39 which connects to pivot hole 43 by the insertion of stub shaft 42 therein through bushing 47. This construction allows tapping plate 39 to rotate concentrically with stub shaft 42 and pivot hole 43 while moving against fixed plate 36. Tapping plate 39 incorporates pin insertion hole 44 which is provided to accept the insertion of pin 53 of tapping link 52 (described below), and swing support shaft 45 which supports the swinging movement of massage arm 40 and shoulder grabber 41.

Fixed massage arm 40 is an approximate "L" shaped plate with one end extending in the forward direction and the other end extending in the downward direction with a massage roller 48 being provided on each of the ends. Fixed massage arm 40 is connected to tapping plate 39 so as to be able to rotate a small amount in respect to tapping plate 39.

Tapping drive portion 17 includes tapping motor 50, tapping eccentric shaft 51, and tapping link 52 that operate to convey a tapping movement to massage roller 48, at the region where the recipient is massaged, through moving bracket 32 by means of the motion whereby moving bracket 32 swings relative to fixed bracket 31.

Tapping eccentric shaft 51, which is rotatably provided between right and left segment gears 18, is rotatably driven by tapping motor 50. As can be seen in FIGS. 5 and 6, tapping link 52 is connected to eccentric portion 57 of tapping eccentric shaft 51 and to pin 53 on moving bracket 32, and thus operates with a pendulum-like tapping motion as a result of the eccentric motion of eccentric portion 57 driving moving bracket 32 with respect to fixed bracket 31.

Further, a massaging motion can be provided through the pressure applied by massage roller 48, the tapping motion also applied to massage roller 48, and the massaging movement of massage roller 48 and grip member 62 of shoulder grabber 41.

Shoulder grabber 41 incorporates swing arm 61 that moves with a swinging motion with respect to moving bracket 32, grip member 62 that is attached to the leading edge of swing arm 61, and airbag 63 that drives swing arm 61. Air pump 71, which is attached to main block 13, supplies air to airbag 63 through tube 70. Airbag 63 is thus able to drive swing arm 61, to which grip member 62 is installed, with a swinging motion.

As a result of the above described mechanisms, massage unit 3, to which the massaging member is attached, is able to provide a massaging motion in both vertical and horizontal directions while massage roller 48 moves in fore and aft (extending and retracting) directions with respect to the massage recipient. Pressure sensing mechanism 8 is provided to monitor the pressure applied to the massage recipient by massage roller 48, and as a result of monitoring this pressure, the pressure sensing mechanism is able to record the contour over which massage roller 48 travels on the massage recipient. Various massages can then be executed based on the recorded contour.

Pressure sensing mechanism 8 includes flexible member 81 which is provided in the transmission through which massage roller 48 is driven by extension drive unit 15. Flexible member 81 may include any suitable flexible member such as, for example, a coil spring 81. Pressure sensing mechanism 8 comprises worm gear 92*a*, worm shaft 92, worm wheel 95, coil spring 81, gap sensor 82, and pickup element 96. Because the displacement of flexible member 81 can be monitored, and the pressure applied to the massage recipient calculated, a structure is formed that can operate as a displacement gauge able to monitor flexible member 81 and its flexible displacement.

FIG. 1 describes the transmission structure within extension gear box 24. Rotating coupling 91 is connected to output shaft 23*a* of extension drive motor 23, and worm shaft 92 is connected to rotating coupling 91 so as to be movable in the axial direction therein. Bearing 93 is installed over worm shaft 92, and is axially movable within bearing holder ring 94 which is fixedly connected to extension gear box 24. Therefore, worm shaft 92 is able to slide in the axial direction through rotating coupling 91 while also being rotationally driven by extension drive motor 23 through the connection with rotating coupling 91. Worm gear 92*a* is axially formed around the center portion of worm shaft 92, and worm wheel 95 is provided so as to mesh with worm gear 92*a*. Worm wheel 95 is rotationally supported by extension gearbox 24, and extension drive shaft 25 is installed at the radial center of worm wheel 95. The revolving motion of worm shaft 92 is transferred to extension drive shaft 25 through worm wheel 95, thus resulting in massage roller 48 applying pressure against the massage recipient through the above described elements.

Moreover, flange 92*b* is formed on the external surface of worm shaft 92 adjacent the shaft 92 and connects to rotating coupling 91, and presses against one end of a flexible member 81 at the coupling 91 side of flange 92*b*. The other end of the coil spring, within which rotating coupling 91 passes, presses against a surface of extension gearbox 24, thereby forming a structure through which the spring applies pressure to worm shaft 92 in a direction opposite to extension drive motor 23.

Extension drive motor 23 turns worm shaft 92, through rotating coupling 91, while pressure is applied to the massage recipient by massage roller 48. This results in the application of pressure to the portion of worm wheel 95 in contact with worm shaft 92 in the direction opposite to extension drive motor 23. Worm shaft 92 is normally maintained in a position farthest away from extension drive motor 23 as a result of the pressure applied by the coil spring 81.

Therefore, pressure applied against massage roller 48 results in the part of worm wheel 95 in mesh with worm shaft 92 moving toward extension drive motor 23, thus resulting in worm shaft 92 moving in a direction against the pressure applied by the coil spring or flexible member 81. As a result, the amount of pressure applied to massage roller 48 can be calculated by applying the measured displacement of worm shaft 92 and the operating characteristics of the flexible member 81.

Figure 2:
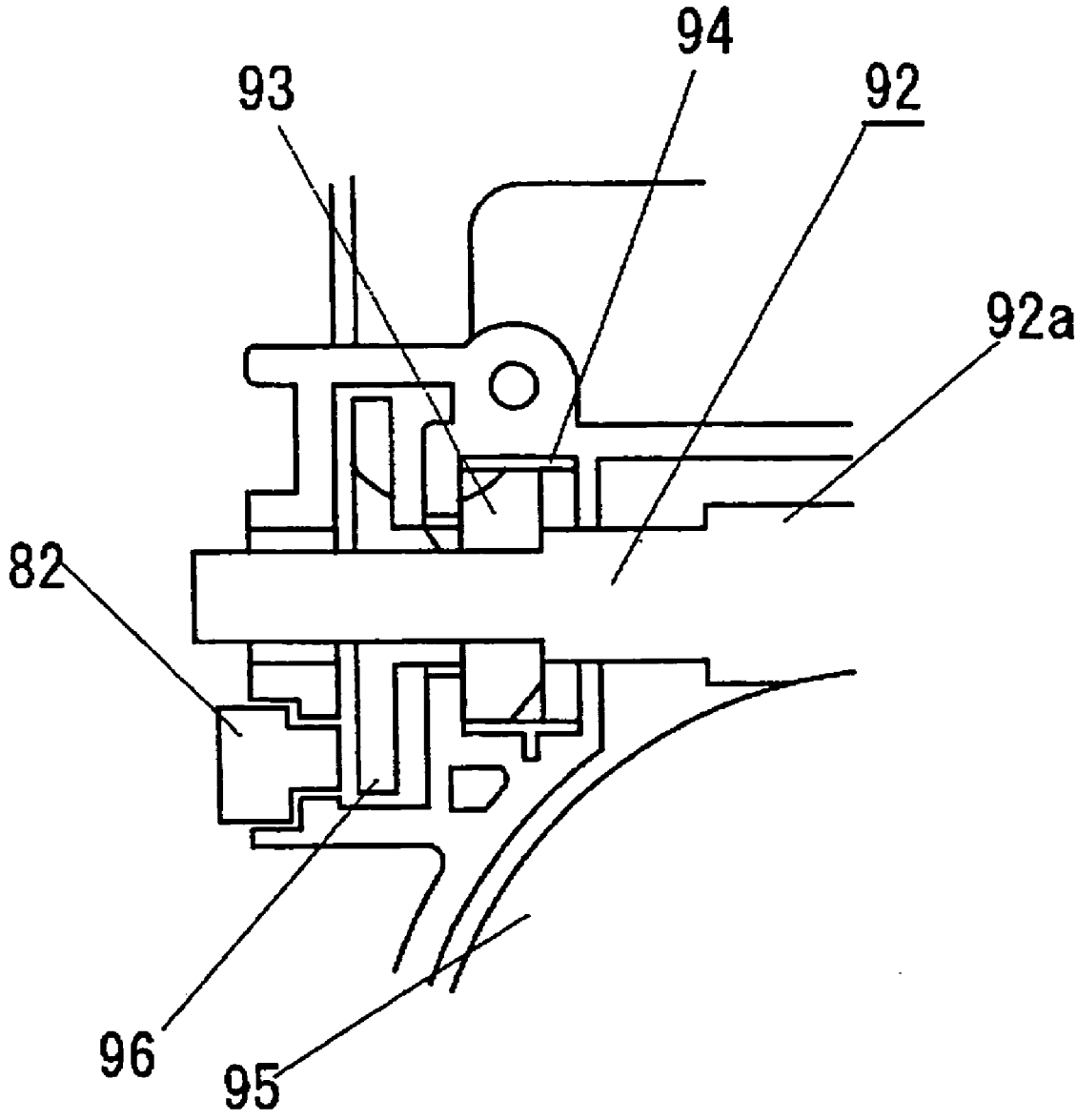
FIG. 2 is an enlarged portion of the cross sectional view of the embodiment of FIG. 1.

It thus becomes possible to indirectly measure the displacement of flexible member 81 through a displacement gauge that measure the displacement of worm shaft 92. As shown in FIGS. 1 and 2, this embodiment incorporates a flange-type pickup element 96 at the end of worm shaft 92 opposite to extension drive motor 23, and gap sensor 82 connected to extension gearbox 24 as means of measuring the distance to pickup element 96. The gap sensor may be any suitable sensor such as, for example, a non-contact displacement gauge such as an eddy current sensor.

A shown in FIG. 2, the pressure applied against the massage recipient can be calculated by measuring the distance between gap sensor 82 and pickup element 96 on worm shaft 92. The use of gap sensor 82 allows the pressure sensing mechanism to be made smaller and lighter. Gap sensor 82 may take the form of a variable resistance sensor, such as a potentiometer, instead of the previously noted non-contact type sensor. A potentiometer is a type of sensor that can eliminate the possibility of external interference, such as electric noise, which can adversely affecting sensor operation.

The structure described above provides a method of measuring the pressure applied to the massage recipient without using a large number of specialized components and devices. Because the structure incorporates flexible member 81 as part of the transmission used in extension drive unit 15, and a displacement gauge including only a few components, the problems of erroneous calculation and difficult assembly and adjustment, that is, problems that occur when the pressure applied to the massage recipient is conveyed through a large number of components, are eliminated.

The following will explain how pressure sensing mechanism 8 determines the position of the massaging element with respect to massage recipient's shoulders.

The position of the shoulders is determined as the mid-point of a distance established in relation to upper and lower pressure reference values monitored through the position of massage roller 48. That is, as extension drive unit 15 gradually presses massage roller 48 against the massage recipient, the increase in pressure is calculated by pressure sensing mechanism 8. The extent of extension (in this embodiment, the rotational angle of segment gears 18) of massage roller 48 against the massage recipient is monitored at the points where the applied pressure equals predetermined upper and lower reference values. The mid-point between these two extending positions of massage roller 48 is determined as the position of the shoulders.

Fixed values can be taken from the stroke of worm shaft 82 through its entire range in the space provided in extension gearbox 24 as a result of the stroke being determined by the pressure applied to the massage recipient. Thus, the lower and upper reference values, which reflect the full length of the stroke, are values that can be effectively measured and established. Further, it is preferable to use a non-linear response spring for flexible member 81 as a linear response spring will narrow the measurement range between the upper and lower limits.

For example, the structure of a non-linear response spring is formed of multiple linear response springs in series alignment with each spring exhibiting a different load rating to maximum compression. All of the springs compress until the first spring bottoms out after which the other springs continue to compress, thus resulting in incremental increases in the spring constant (the load required to compress the spring a specific distance). This type of spring makes it possible to accurately measure a small initial load, the load being less than the lower limit load capable of being measured by conventional pressure sensing mechanisms. Accordingly, this type of measuring device is effective for use with a massage recipient having an extremely light body weight.

Conversely, a non-linear response spring composed of multiple linear response springs in parallel alignment can be structured to provide the opposite characteristic of the spring described in the previous paragraph. That is, the spring can be structured to be effective for use with a massage recipient whose body weight is extremely heavy.

The present invention includes a load sensing mechanism that uses only a few components in the form of a flexible member and displacement gauge, thus eliminating the calculation errors and assembly and adjustment problems associated with load sensing mechanisms that use a large number of components to measure the pressure applied to the massage recipient.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application No. 2003-160013, filed on Jun. 4, 2003, which is herein expressly incorporated by reference in its entirety.

What is claimed is:

1. A massage machine to monitor the pressure applied by a motor driven massage member against the body of a massage recipient, said massage machine including:

a flexible member provided in a transmission positioned between a massage member drive motor and said motor driven massage member; and a pressure sensing mechanism configured to monitor pressure applied to the body of the massage recipient by sensing displacement of said flexible member;

said pressure sensing mechanism including:

a worm shaft provided at a motor side of said transmission and a worm wheel provided on a massage element side of said transmission, said worm shaft being movable in the axial direction, and tensioned in the axial direction by said flexible member comprising a spring; and a displacement gauge configured to monitor the amount of axial displacement of said worm shaft resulting from pressure of the massage member against the body of the massage recipient transferred to said worm shaft through said worm wheel.

2. The massage machine according to claim 1 wherein said displacement gauge comprises a gap sensor.

3. The massage machine according to claim 1 wherein said displacement gauge comprises a potentiometer.

4. The massage machine according to claim 1 wherein said spring configured to apply pressure to said worm shaft is a nonlinear response spring.

5. The massage machine according to claim 4 wherein said nonlinear response spring comprises multiple linear response springs arranged in series alignment.

6. The massage machine according to claim 4 wherein said nonlinear response spring comprises multiple linear springs arranged in parallel alignment.

* * * * *